United States Patent [19]

Kritske

[11] 4,381,095

[45] Apr. 26, 1983

[54] APPARATUS FOR SUPPORTING A WORK SURFACE

[75] Inventor: Victor J. Kritske, Sheboygan, Wis.

[73] Assignee: Mayline Co., Inc., Sheboygan, Wis.

[21] Appl. No.: 196,746

[22] Filed: Oct. 14, 1980

[51] Int. Cl.[3] ..... F16M 11/00

[52] U.S. Cl. ..... 248/161; 108/144; 248/188.5; 248/412

[58] Field of Search ..... 248/188.5, 188.2, 414, 248/412, 354 R, 125, 124, 123, 162.1, 161; 108/146, 148, 144; 403/109

[56] References Cited

U.S. PATENT DOCUMENTS

| | | | |
|---|---|---|---|
| 3,285,207 | 11/1966 | Hagen | 248/161 X |
| 3,467,352 | 9/1969 | Bohler | 248/412 X |
| 3,807,574 | 4/1974 | Lanza | 248/412 X |
| 3,888,444 | 6/1975 | Yindra et al. | 248/188.5 |
| 3,976,016 | 8/1976 | Longbottom | 248/412 X |
| 4,195,578 | 4/1980 | Benoit et al. | 248/412 X |

FOREIGN PATENT DOCUMENTS

| | | | |
|---|---|---|---|
| 450054 | 7/1948 | Canada | 108/148 |
| 1247425 | 10/1960 | France | 108/146 |
| 1430275 | 1/1966 | France | 248/414 |

*Primary Examiner*—James T. McCall
*Assistant Examiner*—Sarah A. Lechok
*Attorney, Agent, or Firm*—Irwin C. Alter

[57] ABSTRACT

An apparatus for supporting a work surface, such as a drafting table, that requires both vertical adjustability and a great degree of stability once the desired elevation is achieved. Interposed between two telescoping column members are a series of spring-connected wheel assemblies that cooperate to apply a holding force to the base column member in order to maintain the extendable column member at its desired attitude of elevation.

8 Claims, 6 Drawing Figures

APPARATUS FOR SUPPORTING A WORK SURFACE

BACKGROUND OF THE INVENTION

The present invention relates generally to tables and supporting means, and particularly to a telescoping column member arrangement for supporting a work surface.

Work surfaces, such as drafting tables, demand that the work surfaces be kept free from undesired horizontal or vertical movement, while work is being performed thereon. However, it is often necessary to alter the elevation of the work surface depending upon the task being performed or the individual using the surface.

The present invention uses two telescoping, hollow, rectangular members, one of which is retractable or extendable to a desired working elevation.

The present invention has as an object the maintenance of a work surface virtually free from undesired vertical movement. This is accomplished while minimizing the effort required to raise or lower the work surface should the need to do so arise.

In addition, the present invention has as an object the adjustability of the work surface elevation. This objective is accomplished both smoothly and quietly by the bearing mounted stabilizer wheels included in the present invention.

An additional object of the invention is to maintain the work surface virtually free from undesired horizontal movement. Upon the application of a lateral load to the work surface, the stabilizer wheel assemblies of the present invention will respond and serve to counteract such undesired horizontal movement.

Yet another object of the invention is the reduction of resistance to vertical movement when such movement is desired. The stabilizer wheels included in the present invention, cooperate to reduce the stabilizing force when an axial force is applied in order to adjust the elevation of the work surface.

A telescoping column member system for supporting a table, is illustrated in Yindra et al., U.S. Pat. Nos. 3,707,930 and 3,888,444. However, it is believed, that the possibility of work surface wobble will persist in the invention disclosed by the Yindra patent. In that invention the bearing strips are capable of moving only in one direction, outward. Furthermore, each strip must move as a whole, to outwardly adjust to the lateral movement of the inner column with respect to the outer column. However with the present invention, each stabilizer wheel is capable of independently adjusting to changes in the separation between the column members. In addition, unlike the bearing strips of the Yindra invention, the stabilizer wheels in the present invention are capable of rolling along the inner wall of the outer column member thereby facilitating such desired movement. Furthermore, no provision is apparent in the Yindra invention for reducing the resistance to desired vertical movement supplied by the bearing strips contacting the outer tubular member. In the present invention, the stabilizer wheels are capable of independently retracting upon the application of an axial force intended to raise or lower the work surface.

These and other objects of the invention will become apparent in light of the present specification and drawings.

SUMMARY OF THE INVENTION

The present invention comprises an apparatus for supporting a work surface. In a preferred embodiment, the apparatus includes inner and outer telescoping column members having generally rectangular cross-sections. The inner telescoping column member has external cross-sectional dimensions sufficiently smaller than the internal cross-sectional dimensions of the outer column member to thereby make it possible for the inner column member to freely fit inside the outer column member. Furthermore, a substantially horizontal beam member is affixed to one of the telescoping column members.

A plurality of rotatably mounted wheel assemblies are interposed between and contact the outer wall of the inner column member and the inner wall of the outer column member to retain one column member in a selectable attitude of extension. Each wheel assembly includes a bearing block assembly and a stabilizer wheel rotatably attached to the bearing block assembly to allow the wheel to rotate freely with respect to the bearing block assembly. In addition, one of the column members has a plurality of slots formed therethrough. Each of the slots has one of the bearing block assemblies retained slidably therein. One of the stabilizer wheels and one of the bearing block assemblies translate as a unit along each of the slots.

Each such slot in said column members is positioned proximate an edge of the column member, while each said slidable bearing block assembly is translatable from one end of a slot to the other. A stabilizer wheel protrudes past the edge of the inner column member when the bearing block assembly upon which the wheel is mounted is moved to the first end of the slot. However, the wheel withdraws past the edge of the inner column member when the bearing block assembly is moved to the second end of the slot. The wheel assemblies are arranged such that the axis rotation of each stabilizer wheel is perpendicular to the axis of rotation of a horizontally adjacent stabilizer wheel.

Each wheel assembly further includes a spring member, which normally urges the wheel assemblies toward the first end of the slot. The stabilizer wheels thereby are urged to protrude past the edge of the inner column member. As a result, the rims of the outwardly urged protruding stabilizer wheels are normally urged to contact the outer column member. A holding force is then exerted against the outer column member sufficient to prevent undesired movement of the inner column member with respect to the outer column member, by the cooperating outwardly urged stabilizer wheel assemblies.

One or more of the angled slots are located proximate the top of the sides of the inner column member. The top angled slots are oriented such that first ends of said slots are closer to the bottom of the sides of the inner column member and the edge of the inner column member, than the second ends of the slots. The remainder of the angled slots are located proximate the bottom of the sides of the inner column member. The bottom angled slots are oriented such that the first ends of the slots are closer to the top of the sides of the inner column members and the edge of the inner column member than the second ends of the slots. The spring members serve to urge the wheel assemblies toward the first end of the angled slots.

The bottom stabilizer wheels retract upon the application of an upward axial force to the inner column member sufficient to overcome the stabilizing force provided by the cooperating wheel assemblies. However, the top stabilizer wheels will retract upon the application of a downward axial force to the inner column member sufficient to overcome the stabilizing force provided by the cooperating wheel assembly. Upon the application of a lateral load to the inner column member and momentary separation of the stabilizer wheels from the outer column member, the spring connected stabilizer wheels will regain contact with the outer column member.

In summary, the inner column member will move with respect to the outer column member when an axial force of sufficient magnitude to defeat the holding force applied by the wheel assemblies to the outer column member is applied to said inner column member.

DETAILED DESCRIPTION OF THE DRAWINGS

Figure 1:
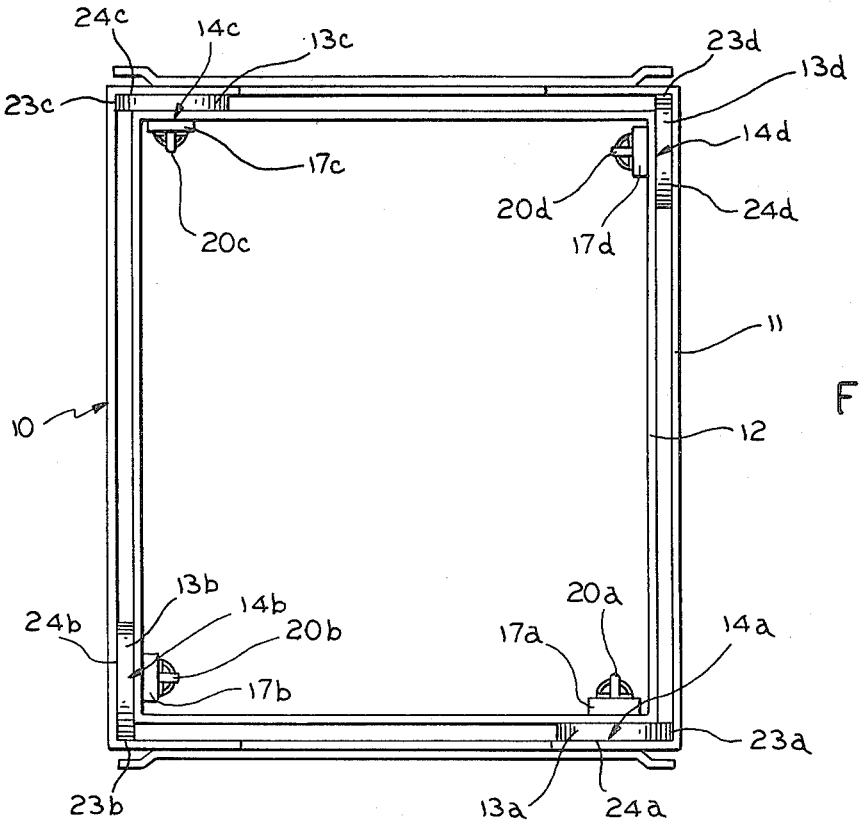
FIG. 1 is a sectional view of FIG. 2 showing particularly the outer and inner telescoping column members and the plurality of stabilizer wheel assemblies.

While this invention is susceptible of embodiment in many different forms, there is shown in the drawings and will herein be described in detail, one specific embodiment, with the understanding that the present disclosure is to be considered as an exemplification of the principles of the invention and is not intended to limit the invention to the embodiment illustrated.

A preferred embodiment of the invention is shown in FIG. 1 where the apparatus 10 for supporting a work surface consists of telescoping column member 12 fitting inside telescoping column member 11 and separated by stabilizer wheels 13*a*, 13*b*, 13*c* and 13*d* whose wheel faces 24*a*, 24*b*, 24*c* and 24*d* contact both outer column 11 and inner column 12 simultaneously. The stabilizer wheels 13*a*, 13*b*, 13*c* and 13*d* are included as part of the stabilizer wheel assemblies 14*a*, 14*b*, 14*c* and 14*d* which are mounted to the inner telescoping column member 12. Each stabilizer wheel assembly 14*a*, 14*b*, 14*c* and 14*d* is secured to the inner column member 12 by the bearing block 17*a*, 17*b*, 17*c* and 17*d*.

Figure 2:
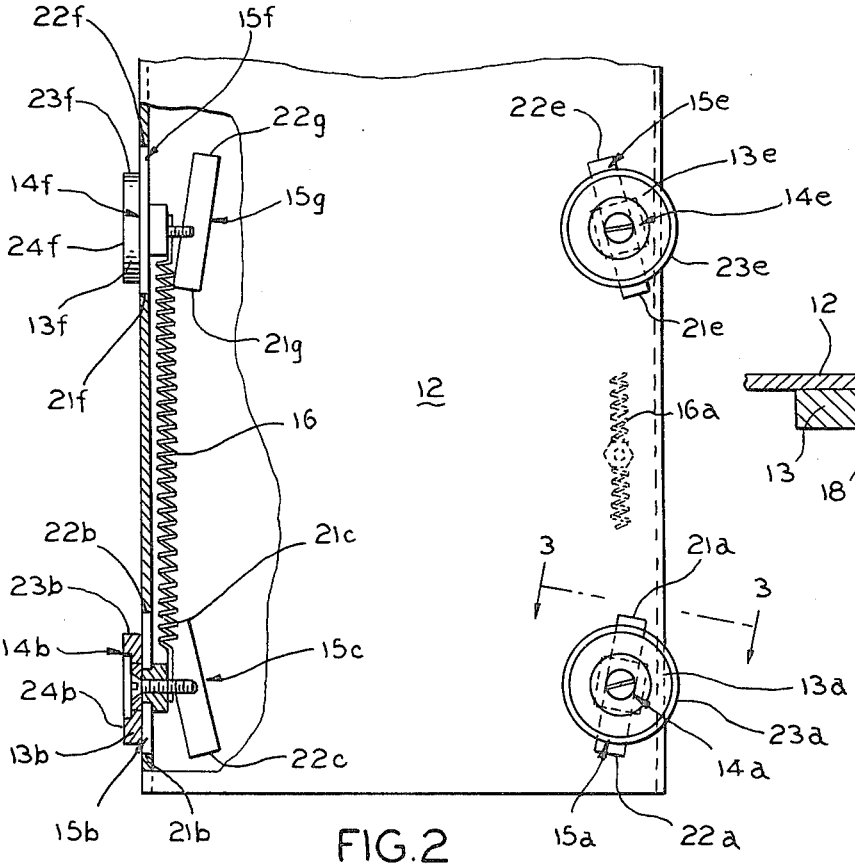
FIG. 2 is a partial cross-sectional front view of the inner telescoping column member showing particularly the stabilizer wheel assembly, spring members, and the plurality of slots formed in the inner telescoping column member.

Inner column member 12 is shown in FIG. 2, with stabilizer wheel assemblies 14*a*, 14*b*, 14*e* and 14*f* affixed thereto. The stabilizer wheel assemblies 14*a*, 14*b*, 14*e* and 14*f* are slidably affixed to the inner column member 12 at the angled slots 15*a*, 15*b*, 15*e* and 15*f* respectively. Furthermore, this embodiment contains a second set of stabilizer wheel assemblies 14*e*, 14*f*, 14*g* and 14*h* vertically adjacent to stabilizer wheel assemblies 14*a*, 14*b*, 14*c* and 14*d* shown as being situated in the same horizontal plane in FIG. 1 and FIG. 2. Of course, varying arrangements of stabilizer wheel assemblies depending upon the size of column members or magnitude of holding force required are possible and should be considered as being within the scope of this invention. A spring member 16 is shown in FIG. 2 as connecting a vertically adjacent pair of stabilizer wheel assemblies 14*b* and 14*f*.

Figure 3:
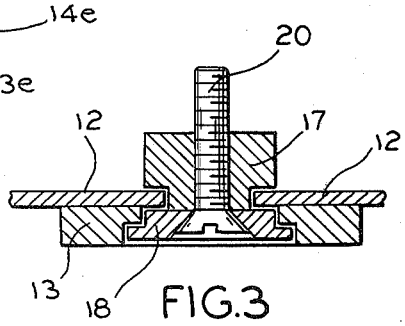
FIG. 3 is a cross-sectional view of the stabilizer wheel assembly taken along line 3—3 of FIG. 2 showing particularly the stabilizer wheel, bearing and bearing block.

FIG. 3 is a cross-sectional view of a typical stabilizer wheel assembly 14 as taken along line 3—3 of FIG. 2 in which the inner column member 12 is interposed between bearing 18 and bearing block 17. Assembly 14 is capable of sliding from one end of the angled slot 15 to the other. Furthermore, stabilizer wheel 13 is rotatably mounted upon bearing 18. Fastener 20 retains stabilizer wheel 13 upon bearing 18 and maintains inner column member 12 between stabilizer wheel 13, bearing 18 and bearing block 17.

Spring member 16 urges stabilizer wheel assembly 14 towards first end 21 of angled slot 15. As a result, stabilizer wheel 13 protrudes past the edge of inner column member 12 and stabilizer wheel rim 23 tangentially contacts and pushes against outer column member 11.

As shown in FIG. 2, spring member 16*a* urges stabilizer wheel assemblies 14*a* and 14*e* towards the first ends 21*a* and 21*e* respectively of angled slots 15*a* and 15*e*. As a result, stabilizer wheels 13*a* and 13*e* protrude past the edge of inner column member 12 and stabilizer wheel rims 23*a* and 23*e* tangentially contact and push against outer column member 11.

Spring member 16 and spring members 16*b* and 16*c*, not shown, respectively serve to urge each remaining pair of vertically adjacent wheel assemblies 14*b* and 14*f*, 14*c* and 14*g*, and 14*d* and 14*h* to protrude past the edges of inner column member 12, resulting in stabilizer wheel rims 23*b*, 23*f*, 23*c*, 23*g*, 23*d* and 23*h* tangentially contacting and pushing against outer column member 11, also.

In addition, when stabilizer wheel rims 23*a* and 23*e* push against outer column member 11, stabilizer wheel faces 24*b* and 24*f* of the next horizontally adjacent stabilizer wheel assemblies in this case, 14*b* and 14*f*, likewise push against outer column member 11. This combination of the rims 23*a*, 23*b*, 23*c*, 23*d*, 23*e*, 23*f*, 23*g* and 23*h* and faces 24*a*, 24*b*, 24*c*, 24*d*, 24*e*, 24*f*, 24*g* and 24*h* of the stabilizer wheel assemblies 14*a*, 14*b*, 14*c*, 14*d*, 14*e*, 14*f*, 14*g* and 14*h* cooperatively pushing against outer column member 11 serves to hold inner column member 12 at its desired attitude of elevation.

Figure 4:
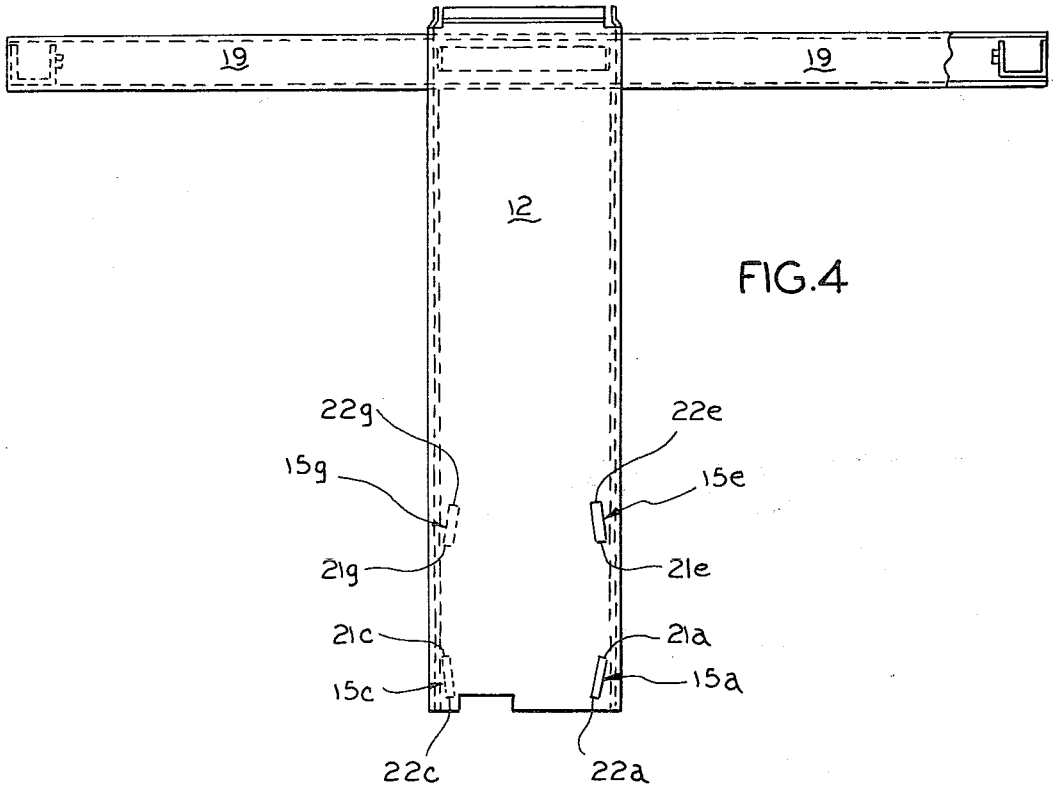
FIG. 4 is a front partial cross-sectional view showing particularly the inner telescoping column member, the horizontal beam member, and the plurality of slots formed in the inner telescoping column member.

A front elevational view of inner column member 12 and a partial cross-sectional view of horizontal beam member 19 is shown in FIG. 4, which also include the angled slots 15*e* and 15*a* in inner column member 12 and angled slots 15*g* and 15*c* in phantom.

Figure 5:
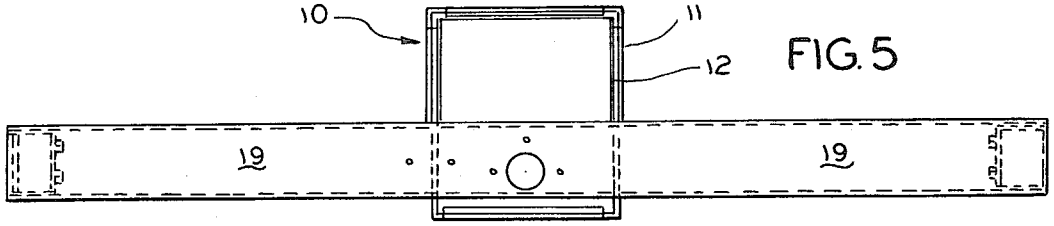
FIG. 5 is a top elevational view of the apparatus for supporting a work surface showing particularly the outer telescoping column member, the inner telescoping column member and the horizontal beam member.

The top elevational view of the apparatus for supporting a work surface 10 is shown in FIG. 5, and includes horizontal beam member 19, inner column member 12 and outer column member 11. As shown in FIG. 5, inner column member 12 fits inside outer column member 11 and furthermore, has attached to it horizontal beam member 19.

As seen in FIG. 2, when an upward axial force is applied to inner column member 12 lower wheel assemblies 14*a*, 14*b*, 14*c* and 14*d* will retract and slide towards second ends 22*a*, 22*b*, 22*c* and 22*d*, of the angled slots 15*a*, 15*b*, 15*c* and 15*d*, respectively, thereby reducing the holding force maintaining inner column 12 at its desired attitude of elevation. Stabilizer wheels 13*a*, 13*b*, 13*c* and 13*d* will then roll along the inner surface of outer column 11 until the desired elevation is achieved.

In like fashion, upon the application of a downward axial force to inner column member 12, upper wheel assemblies 14*e*, 14*f*, 14*g* and 14*h* when viewed as in FIG. 2, will retract and slide towards second ends 22*e*, 22*f*, 22*g* and 22*h* of angled slots 15*e*, 15*f*, 15*g* and 15*h*, respectively, thereby reducing the holding force maintaining the inner column 12 at its desired attitude of elevation. Stabilizer wheels 13*e*, 13*f*, 13*g* and 13*h* will then roll along the inner surface of outer column 11 until the desired elevation is achieved. Spring members 16*a*, 16*b* and 16*c* serve to urge wheel assemblies 14*e*, 14*f*, 14*g* and 14*h* toward the first ends 21*e*, 21*f*, 21*g* and 21*h* of the angled slots 15*e*, 15*f*, 15*g* and 15*h* in order to regain the full amount of holding force when the inner column member 12 is brought to a stop.

The application of a lateral force to inner column member 12 may result in the momentary separation of one or more of the wheel assemblies 14*a*, 14*b*, 14*c*, 14*d*, 14*e*, 14*f*, 14*g* and 14*h* from the outer column member 11. However, the spring members 16*a*, 16*b* and 16*c* will urge the wheel assemblies toward the first ends 21*a*, 21*b*, 21*c*, 21*d*, 21*e*, 21*f*, 21*g* and 21*h* of the angled slots 15, increasing the amount that the wheel assemblies protrude past the edge of the inner column member 12 and thereby causing contact to be regained with the outer column member 11.

Figure 6:
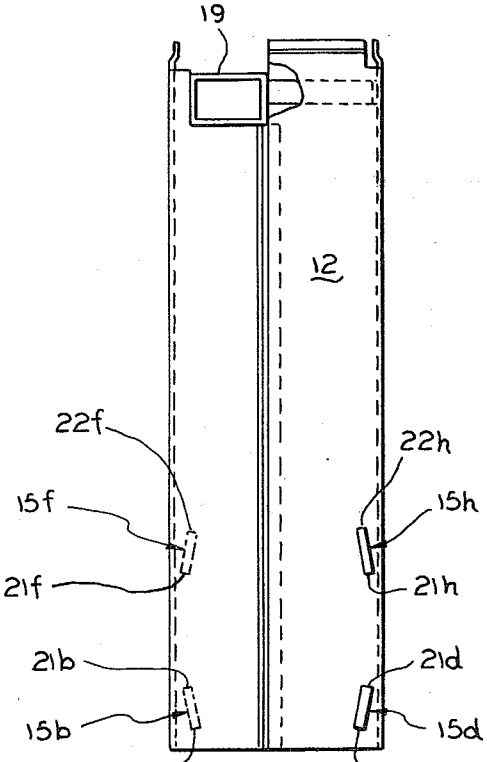
FIG. 6 is a side elevational view of the inner column member showing particularly the horizontal beam member and the plurality of slots formed in the inner telescoping column member.

A partial cross-sectional view of inner column member 12 is provided in FIG. 6. Also shown affixed to inner column 12 is horizontal beam member 19. Angled slots 15*h*, *15d*, and angled slots 15*f* and 15*b* in phantom are also shown upon inner column member 12 in FIG. 6.

The foregoing description and drawings merely explain and illustrate the invention: the invention is not limited thereto, except insofar as the appended claims are so limited, as those skilled in the art who have the disclosure before them will be able to make modifications and variations therein without departing from the spirit and scope of the invention.

What is claimed is:

1. Apparatus for supporting a work surface, said apparatus comprising:

telescoping inner and outer column members, each said column member having a top and bottom and including a plurality of planar side members that meet to form edges therebetween, said inner column member having external cross-sectional dimensions sufficiently smaller than the internal cross-sectional dimension on said outer column member to thereby make it possible for said inner column member to freely fit and slide inside said outer column member;

each said column member having a generally uniform rectangular cross-section;

said inner column member being extendable by telescoping movement with respect to said outer column member;

a plurality of bearing block assemblies;

a stabilizer wheel rotatably attached to each said bearing block assembly to allow said wheel to rotate freely with respect to said bearing block assembly;

said inner column member having a plurality of angled slots formed in said planar side members;

said block assemblies being constrained to move along said angled slots, said angled slots being positioned such that said wheels associated with said bearing block assemblies can be urged in and out of contact with said outer column by moving said block assemblies along said angled slots, whereby said bearing blocks enable said vertical extension by means of a sliding relationship with a minimum amount of horizontal movement while minimizing the force required for such telescoping extension.

2. The apparatus as recited in claim 1 wherein:

each said slot is positioned proximate an edge of said column member, each said slot has a first end and a second end, each of said slidable bearing block assemblies translatable from said first end of said slot to said second end, said wheel protruding past said edge of said inner column member when said bearing block assembly is moved to said first end of said slot, said wheel withdrawing past said edge of said inner column member when said bearing block assembly is moved to said second end of said slot.

3. The apparatus as recited in claim 1 wherein:

each of said wheels has a rim and a face, said rim and said face contacting the outer column members when said wheel assembly is translated toward said first slot end, said wheel assemblies arranged such that the axis of rotation of each said stabilizer wheel is perpendicular to the axis of rotation of an adjacent stabilizer wheel.

4. The apparatus as recited in claim 1 wherein:

each said wheel assembly further includes a spring member, said spring member normally urging said wheel assembly toward said first end of said slot, said stabilizer wheels thereby urged to protrude past said edge of said inner column member, said rim of said outwardly urged protruding stabilizer wheel being urged to contact said outer column member, said outwardly urged stabilizer wheel cooperating with the remaining of said stabilizer wheel assemblies to exert a holding force against said outer column member sufficient to prevent undesired movement of said inner column member with respect to said outer column member.

5. The apparatus as recited in claim 4 wherein:

said angled slots called top angled slots are located proximate to one top of said panel side member, each of said top angled slots orientated such that said first end of said slots are closer to said bottom of said side members and said edge of said inner column member, than said second ends of said slot, the remainder of said angled slots called bottom angled slots are located proximate said bottom of said side members, each of said bottom angled slots are orientated such that said first ends of said slots are closer to said top of said side members and said edge of said inner column member, than said second ends of said slots, said spring members serving to urge said wheel assemblies toward said first ends of said angled slots, wheel assemblies are mounted to said top angled slots, wheel assemblies are mounted to said bottom angled slots, said bottom stabilizer wheels retract upon the application of an upward axial force to said inner column member sufficient to overcome said holding force.

6. The apparatus as recited in claim 4 wherein:

said angled slots called top angled slots are located proximate said top of said side members, each of said top angled slots are orientated such that said first end of said slots are closer to said bottom of said side members and said edge of said inner column member, than said second ends of said slots, the remainder of said angled slots called bottom angled slots are located proximate said bottom of said side members, each of said bottom angled slots are orientated such that said first ends of said angled slots are closer to said top of said side members and said edge of said inner column member, than said second ends of said slots, said spring members serving to urge said wheel assemblies toward said first ends of said angled slots, wheel assemblies are mounted to said top angled slots, wheel assemblies are mounted to said bottom angled slots, said top stabilizer wheels retract upon the application of a downward axial force to said inner column member sufficient to overcome said holding force.

7. The apparatus as recited in claim 5 wherein:

said spring connected stabilizer wheels regain contact with said outer column member upon the application of a lateral load to said inner column member.

8. The invention according to claim 4 wherein said inner column member will move with respect to outer column member when an axial force of sufficient magnitude to defeat said holding force is applied to said inner column member.

* * * * *